US010995599B2

(12) United States Patent
Hou et al.

(10) Patent No.: US 10,995,599 B2
(45) Date of Patent: May 4, 2021

(54) SHALE OIL IN-SITU LIGHTENING DEVELOPMENT METHOD, APPARATUS AND SYSTEM

(71) Applicant: PetroChina Company Limited, Beijing (CN)

(72) Inventors: Lianhua Hou, Beijing (CN); Caineng Zou, Beijing (CN); Suyun Hu, Beijing (CN); Jinhua Fu, Beijing (CN); Xianyang Liu, Beijing (CN); Xia Luo, Beijing (CN); Jinghong Wang, Beijing (CN); Lijun Zhang, Beijing (CN); Senhu Lin, Beijing (CN); Zhi Yang, Beijing (CN); Songtao Wu, Beijing (CN); Jingwei Cui, Beijing (CN)

(73) Assignee: PetroChina Company Limited, Beijing (CN)

( * ) Notice: Subject to any disclaimer, the term of this patent is extended or adjusted under 35 U.S.C. 154(b) by 0 days.

(21) Appl. No.: 16/508,752

(22) Filed: Jul. 11, 2019

(65) Prior Publication Data

US 2020/0018145 A1 Jan. 16, 2020

(30) Foreign Application Priority Data

Jul. 12, 2018 (CN) ..... 201810763247.7

(51) Int. Cl.
*E21B 43/30* (2006.01)
*E21B 43/24* (2006.01)
*E21B 49/00* (2006.01)

(52) U.S. Cl.
CPC ..... *E21B 43/305* (2013.01); *E21B 43/2401* (2013.01); *E21B 49/00* (2013.01)

(58) Field of Classification Search
None
See application file for complete search history.

(56) References Cited

U.S. PATENT DOCUMENTS

2003/0192693 A1* 10/2003 Wellington ..... E21B 41/0064 166/267
2008/0087420 A1 4/2008 Kaminsky et al.
(Continued)

FOREIGN PATENT DOCUMENTS

CN 101595273 A 12/2009
CN 102606128 A 7/2012
(Continued)

OTHER PUBLICATIONS

Method of determining microscopically the reflectance of vitrinite in coal. SY/T 5124-2012 (2012).
(Continued)

*Primary Examiner* — Andrew Sue-Ako
(74) *Attorney, Agent, or Firm* — Hamilton, Brook, Smith & Reynolds, P.C.

(57) ABSTRACT

Embodiments of the present disclosure disclose a shale oil in-situ lightening development method, apparatus and system, wherein the method comprises: determining an effective shale interval according to an interval with a total organic carbon greater than a first lower limit value in a target stratum; determining a favorable region for shale oil in-situ lightening development according to a thickness of the effective shale interval and an effective layer thickness ratio, wherein the effective layer thickness ratio includes a ratio of the thickness of the effective shale interval to a thickness of a shale section, and the shale section includes the effective shale intervals and interlayers therebetween. By utilizing the embodiments of the present disclosure, the benefit of the shale oil in-situ lightening development can be improved.

15 Claims, 4 Drawing Sheets

(56) References Cited

U.S. PATENT DOCUMENTS

| | | | |
|---|---|---|---|
| 2010/0089575 | A1 | 4/2010 | Kaminsky |
| 2014/0352957 | A1 | 12/2014 | Chen et al. |
| 2016/0024901 | A1 | 1/2016 | Youhong et al. |
| 2020/0018740 | A1* | 1/2020 | Hou ..... G01N 33/2841 |

FOREIGN PATENT DOCUMENTS

| | | | |
|---|---|---|---|
| CN | 103114831 | A | 5/2013 |
| CN | 103321618 | A | 9/2013 |
| CN | 104392272 | A | 3/2015 |
| CN | 104453873 | A | 3/2015 |
| CN | 104632201 | A | 5/2015 |
| CN | 105971575 | A | 9/2016 |
| CN | 106499376 | A | 3/2017 |
| CN | 106753503 | A | 5/2017 |
| CN | 107387052 | A | 11/2017 |
| CN | 107688669 | A | 2/2018 |
| CN | 107818518 | A | 3/2018 |

OTHER PUBLICATIONS

Research and practice of oil shale reverse recovery technology, China Coal vol. 34, No. 4, pp. 61-64 (2008).

Su, S. et al., "Study of the main controlling factors of shale oil enrichmnent in the Zhanhua Sag", Petroleum Science Bulletin, 2(2): 187-197 (2017).

Rock pyrolysis analysis, GB/T 18602-2012 (2012).

Geochemical Evaluation of Terrestrial Hydrocarbon Source Rocks, SY/T 5735-1995 (1995).

A method for the identification and classification of the microcomponents of transmitted light-fluorescence kerogen, SY/T 5124-1996 (1996).

Search Report for counterpart Chinese Application No. 2018107632477 dated Apr. 16, 2020 "Shale Oil In-Situ Lightening Development Method, Apparatus and System."

* cited by examiner

SHALE OIL IN-SITU LIGHTENING DEVELOPMENT METHOD, APPARATUS AND SYSTEM

RELATED APPLICATION

This application claims priority under 35 U.S.C. § 119 or 365 to China, Application No. 201810763247.7, filed Jul. 12, 2018. The entire teachings of the above application are incorporated herein by reference.

TECHNICAL FIELD

The present disclosure relates to the technical field of exploration and development, and in particular to a shale oil in-situ lightening development method, apparatus and system.

BACKGROUND

The shale oil has become an important field in the global oil exploration and development. However, the practices of exploration and development have proved that when the shale vitrinite reflectance (Ro) is less than 0.95%, the existing horizontal well volume pressure technology cannot realize a scaled economic development. The shale oil can be developed by adopting the in-situ lightening technology, which converts the unconverted organic matters and the generated hydrocarbons in the shales with medium and low maturities into light oil and natural gas through an in-situ electric heating method.

Many companies and universities at home and abroad have developed a large number of methods and technologies, such as radiation heating, convection heating and thermal conduction heating. A small amount of oil and gas can be obtained when an in-situ development is carried out by utilizing any of the prior arts. However, the existing methods have the defects such as low energy replacement ratio, poor benefit, complex downhole process equipment, less oil and gas output, output of thick oil, difficult temperature control and the like, which is not conducive to the cost control and the environmental protection, and cannot carry out a large-scale economic development. Moreover, the existing methods are basically aimed at the in-situ developments of shallow oil shale and are not suitable for the in-situ development of shale oil buried deeper.

Therefore, there is an urgent need in the industry for a method that can effectively develop the shale oil rich in organic matters with medium and low maturities.

SUMMARY

An objective of the embodiments of the present disclosure is to provide a shale oil in-situ lightening development method, apparatus and system, which can improve the benefit of the shale oil in-situ lightening development.

The shale oil in-situ lightening development method, apparatus and system provided by the present disclosure are implemented as follows:

A shale oil in-situ lightening development method, comprising:

determining an effective shale interval according to an interval with a total organic carbon greater than a first lower limit value in a target stratum;

determining a favorable region for shale oil in-situ lightening development according to a thickness of the effective shale interval and an effective layer thickness ratio, wherein the effective layer thickness ratio includes a ratio of the thickness of the effective shale interval to a thickness of a shale section, and the shale section includes the effective shale intervals and interlayers therebetween.

In another embodiment of the method provided by the present disclosure, determining an effective shale interval according to an interval with a total organic carbon greater than a first lower limit value in a target stratum comprises:

determining a region to be selected according to a kerogen type of the target stratum; and determining the effective shale interval according to an interval with a total organic carbon greater than the first lower limit value in the region to be selected.

In another embodiment of the method provided by the present disclosure, determining a favorable region for shale oil in-situ lightening development comprises:

determining the shale section as a favorable interval when a thickness of the interlayer is less than a first preset threshold, a thickness of the shale section is greater than a second lower limit value, and the effective layer thickness ratio is greater than a third lower limit value;

or, determining the effective shale interval as a favorable interval when the thickness of the effective shale interval is greater than a fourth lower limit value;

determining the favorable region for shale oil in-situ lightening development according to the favorable interval.

In another embodiment of the method provided by the present disclosure, the method further comprises:

determining a well arrangement mode for shale oil in-situ lightening development in the favorable region, comprising:

arranging heating wells and production wells in the favorable region, wherein the heating well and the production well each comprises a vertical section and a horizontal section, and a heater is disposed in the horizontal section of the heating well.

In another embodiment of the method provided by the present disclosure, determining a well arrangement mode for shale oil in-situ lightening development in the favorable region comprises:

adopting a vertical section cased hole completion and a horizontal section open hole completion for the heating wells, and adopting a screen pipe completion for the production wells.

In another embodiment of the method provided by the present disclosure, determining a well arrangement mode for shale oil in-situ lightening development in the favorable region comprises:

arranging the heating wells in parallel in a single layer with linearly equal spacing, and locating the production wells between the heating wells, when a thickness of the shale section is less than or equal to a second preset threshold;

arranging the heating wells in two or more layers at a triangular pattern, arranging the production wells at a triangular pattern, and locating the production wells between the heating wells, when the thickness of the shale section is greater than the second preset threshold.

In another embodiment of the method provided by the present disclosure, determining a well arrangement mode for shale oil in-situ lightening development in the favorable region comprises:

arranging the heating wells and/or the production wells with equal spacing, when the thickness of the shale section is greater than the second preset threshold.

In another embodiment of the method provided by the present disclosure, determining a well arrangement mode for shale oil in-situ lightening development in the favorable region comprises:

arranging the heating wells along a longitudinal centerline of the shale interval, when the thickness of the shale section is less than the second preset threshold.

In another embodiment of the method provided by the present disclosure, determining a well arrangement mode for shale oil in-situ lightening development in the favorable region comprises:

arranging the heating wells in a lowest layer in parallel to a lower boundary of the shale interval, and orderly arranging the heating wells in an upper layer in a triangle with the heating wells in an adjacent lower layer and arranging the heating wells in an upper layer in parallel to the heating wells in an adjacent lower layer, when the thickness of the shale section is greater than the second preset threshold.

In another embodiment of the method provided by the present disclosure, determining a well arrangement mode for shale oil in-situ lightening development in the favorable region comprises:

orderly arranging the heating wells in an upper layer and the heating wells in an adjacent lower layer in an equilateral triangle with an included angle of 60°, when the thickness of the shale section is greater than the second preset threshold.

In another embodiment of the method provided by the present disclosure, determining a well arrangement mode for shale oil in-situ lightening development in the favorable region comprises: determining a heating well spacing according to heating time.

In another embodiment of the method provided by the present disclosure, determining a well arrangement mode for shale oil in-situ lightening development in the favorable region comprises:

determining a production well spacing according to a principle of a maximum net value of oil and gas output from the production wells.

In another embodiment of the method provided by the present disclosure, determining a well arrangement mode for shale oil in-situ lightening development in the favorable region comprises:

determining lengths of the horizontal sections of the heating well and the production well according to a principle of a maximum net value of cumulative oil and gas output from the production wells.

In another embodiment of the method provided by the present disclosure, the method further comprises:

determining a heating mode for shale oil in-situ lightening development in the favorable region, comprising:

a heating sequence of the heating wells: the heating wells in a distance less than or equal to one heating well spacing from the production wells are started to be heated for a preset heating time firstly, then the heating wells in a distance less than or equal two heating well spacings from the production wells are started to be heated for a preset heating time, and the rest is started to be heated in the same manner until all the heating wells are started;

a heating procedure of the heating wells: after a surface temperature of the heater rises to a highest preset temperature, the highest preset temperature is maintained for a first preset time, then the surface temperature of the heater is lowered to a continuous constant temperature at a preset cooling speed; all the heating wells corresponding to the production wells are maintained at the continuous constant temperature for a second preset time, and then stop being heated.

In another embodiment of the method provided by the present disclosure, the method further comprises:

determining an oil recovery mode for shale oil in-situ lightening development in the favorable region, comprising:

recovering oil by pumping type from the production well, wherein an oil well pump is located in the vertical section of the production well above the target stratum for a preset distance that ranges from 100 m to 300 m;

wherein a material of an oil well pumping device for the production well withstands a fluid temperature that ranges from 300° C. to 450° C.

In another aspect, the embodiments of the present disclosure further provide a shale oil in-situ lightening development apparatus, comprising:

an effective interval determination module configured to determine an effective shale interval according to an interval with a total organic carbon greater than a first lower limit value in a target stratum;

a favorable region determination module configured to determine a favorable region for shale oil in-situ lightening development according to a thickness of the effective shale interval and an effective layer thickness ratio, wherein the effective layer thickness ratio includes a ratio of the thickness of the effective shale interval to a thickness of a shale section, and the shale section includes the effective shale intervals and interlayers therebetween.

In another aspect, the embodiments of the present disclosure further provide a shale oil in-situ lightening development device, comprising a processor and a memory for storing instructions executable by the processor, wherein when being executed by the processor, the instructions implement the steps of:

determining an effective shale interval according to an interval with a total organic carbon greater than a first lower limit value in a target stratum;

determining a favorable region for shale oil in-situ lightening development according to a thickness of the effective shale interval and an effective layer thickness ratio, wherein the effective layer thickness ratio includes a ratio of the thickness of the effective shale interval to a thickness of a shale section, and the shale section includes the effective shale intervals and interlayers therebetween.

In another aspect, the embodiments of the present disclosure further provide a shale oil in-situ lightening development system, comprising the heating wells, the production wells and the heaters arranged in the favorable region in the method according to any one of above embodiments, and heating cables;

the heating well and the production well each comprises a vertical section and a horizontal section, the heating cable and the heater are connected through a connector, the heating cable and the connector are disposed in the vertical section of the heating well, and the heater is disposed in the horizontal section of the heating well.

In another embodiment of the system provided by the present disclosure, the vertical section of the heating well is provided with a packer that is disposed between the heater and the connector, and cement is filled above the packer for well sealing.

The shale oil in-situ lightening development method, apparatus and system provided by one or more embodiments of the present disclosure can determine an effective shale stratum interval based on the total organic carbon data, and then determine a favorable region suitable for shale oil in-situ lightening development by analyzing the thickness and proportion of the effective shale interval. Next, the well arrangement mode may be optimized in a region that meets the favorable region conditions, thereby realizing the scaled economic shale oil in-situ lightening development.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

The teachings of all patents, published applications and references cited herein are incorporated by reference in their entirety.

In order that a person skilled in the art can better understand the technical solutions in the present disclosure, the technical solutions in one or more embodiments of the present disclosure will be described clearly and completely as follows with reference to the drawings in one or more embodiments of the present disclosure. Obviously, those described are merely parts, rather than all, of the embodiments of the present disclosure. Based on one or more embodiments in the present disclosure, any other embodiment obtained by a person skilled in the art without paying any creative labor should fall within the protection scope of the present disclosure.

The shale oil is a general designation of generated petroleum hydrocarbons and unconverted organic matters in the shales rich in organic matters with a burial depth of more than 300 meters and medium and low maturities. The shales of medium and low maturities have extremely low porosity and permeability and poor connectivity, and the flow of fluid therein is difficult.

The embodiments of the present disclosure provide a shale oil in-situ lightening development method, which determines a favorable interval and a favorable region through a preset standard, thereby providing a target and direction for the shale oil in-situ lightening development, and reducing the exploration and development risk. Further, an optimization design for the well arrangement mode and the like is carried out in the favorable region, so that the efficiency of the shale oil in-situ lightening development is improved through a production mode by pumping type. In addition, the heating is carried out according to a preset heating procedure, the temperature changes are monitored in real time, and the crude oil output is improved to a maximum extent. By adopting the solutions provided by the embodiments of the present disclosure, the recovery rate of the shale oil is greatly increased, thereby improving the benefit of the shale oil in-situ lightening development.

Figure 1:
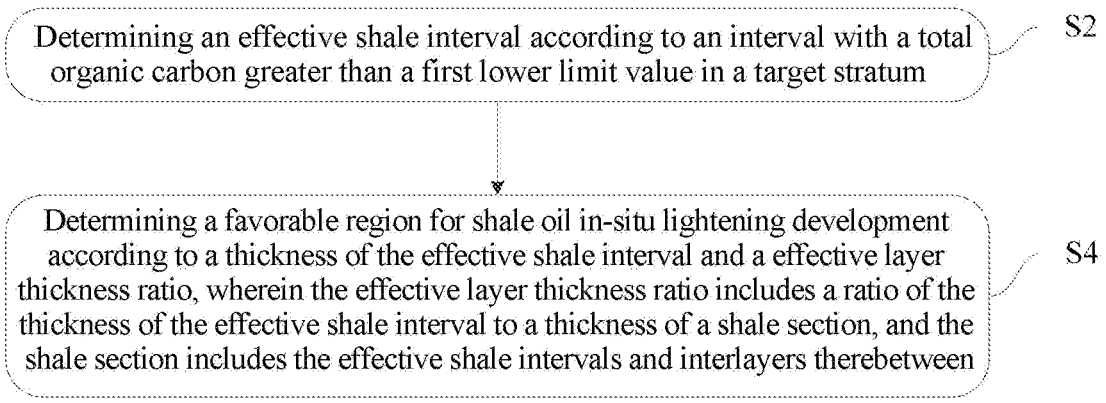
FIG. 1 is a flowchart of an embodiment of a shale oil in-situ lightening development method provided by the present disclosure.

FIG. 1 is a flowchart of an embodiment of a shale oil in-situ lightening development method provided by the present disclosure. Although the present disclosure provides the method operation steps or apparatus structures illustrated in the following embodiments or drawings, more operation steps or module units, or less ones after partial combination, may be included in the method or apparatus based on conventional or non-creative labors. In the steps or structures having no necessary causal relationship logically, the execution sequence of these steps or the module structures of the apparatus are not limited to those illustrated in the embodiments of the present disclosure or the drawings. When the method steps or module structures are applied to the actual apparatus, server or terminal product, they can be executed sequentially or in parallel according to those illustrated in the embodiments or drawings (e.g., under an environment of parallel processors or multithreaded processing, and even an implementation environment including distributed processing and server cluster).

A specific embodiment is illustrated in FIG. 1. In one embodiment of the shale oil in-situ lightening development method provided by the present disclosure, the method may comprise:

S2: determining an effective shale interval according to an interval with a total organic carbon greater than a first lower limit value in a target stratum.

The total organic carbon (TOC) refers to the carbon existing in the organic matters in a rock, and is usually expressed by a mass percent in the rock. It is possible to acquire the log data and core analysis TOC data of the shale intervals of the target stratum in the research region, or collect shale core samples of the target stratum in the research region, and measure the TOC of the core samples according to certain standards. For example, the log data may be calibrated through the TOC data of the core analysis according to the log data and the core analysis data acquired, so as to build a TOC evaluation model as follows:

$$\mathrm{TOC}=a_0+a_1\times\Delta t+a_2\times\rho+a_3\times GR \quad (1)$$

wherein TOC represents a total organic carbon content, Δt represents an acoustic time difference log value, ρ represents a density log value, GR represents a natural gamma log value, and $a_{10}$, $a_{11}$, $a_{12}$ and $a_{13}$ represent empirical parameters. In some embodiments, when the units of Δt, ρ and GR data are μs/m, g/cm3 and API, respectively, the values of $a_{10}$, $a_{11}$, $a_{12}$ and $a_{13}$ may be 56.44, −0.049, −17.05 and 0.037, respectively.

In some embodiments of the present disclosure, a TOC average value of well points of the shale interval of the target stratum in the research region may be obtained, and TOC data of the shale intervals of the whole research region may be obtained by interpolation. The TOC value of a shale interval of the research region may be taken as one of the judgement factors for analyzing whether the shale interval is favorable for oil and gas development, so as to determine an effective shale interval suitable for in-situ lightening development.

An effective shale interval may be determined by obtaining a shale interval of the target stratum with a TOC value greater than the first lower limit value. The shale intervals may be classified according to their TOC values, and a shale interval with a TOC value greater than the first lower limit value may be determined as an effective shale interval favorable for oil and gas development. In some embodiments of the present disclosure, for example, the first lower limit value may include 5% to 7%, preferably 6%, and a shale interval with a TOC value greater than the first lower limit value is calculated as an effective shale interval.

In one embodiment of the present disclosure, a region to be selected may also be determined according to a kerogen type of the target stratum, and an effective shale interval may be determined according to an interval with a TOC value greater than the first lower limit value in the region to be selected.

The shale core samples of the target stratum in the research region may be collected; an hydrogen index (HI) and an oxygen index (OI) are measured according to the national standard, *Rock Pyrolysis* GB/T 18602-2012; a ratio of hydrogen atoms to carbon atoms in kerogen (H/C) and a ratio of oxygen atoms to carbon atoms in kerogen (O/C) are measured according to the industrial standard, *Geochemical Evaluation Method for Terrestrial Hydrocarbon Source Rocks* SYT 5735-1995; and further, the obtained kerogen composition is measured according to *Transmission Light-Fluorescence Kerogen Maceral Identification and Type Classification Method* SY/T 5125-1996 based on the above parameters. The kerogen type of the target stratum in the research region is determined, and a distribution region where the kerogen type is type I or type II or a mixture of type I and type II is preferred as a region to be selected. Next, an interval with a TOC value greater than the first lower limit value in the region to be selected is obtained and determined as an effective shale interval. Further, a shale vitrinite reflectance Ro of may be measured according to the industrial standard, *Measurement Method for Vitrinite Reflectance in Sedimentary Rocks* SY/T 5124-2012, and the region to be selected may be further determined in combination with Ro of the target stratum in the research region, wherein a value range of Ro may be 0.2% to 1.1%, and preferably 0.35% to 0.95%.

S4: determining a favorable region for shale oil in-situ lightening development according to a thickness of the effective shale interval and an effective layer thickness ratio, wherein the effective layer thickness ratio includes a ratio of the thickness of the effective shale interval to a thickness of a shale section, and the shale section includes the effective shale intervals and interlayers therebetween.

The shale section may include the effective shale intervals and interlayers therebetween, and the effective layer thickness ratio may include a ratio of the thickness of the effective shale interval to the thickness of the shale section. In some embodiments of the present disclosure, the thickness of the effective shale interval and the thickness of the interlayer may be calculated according to the TOC data plane distribution in the research region, so as to further calculate the thickness data and the effective layer thickness ratio data of the shale section. The thickness data and effective layer thickness ratio data of the shale section in the research region may be analyzed according to a preset standard, and then a favorable region suitable for in-situ lightening development in the research region is determined according to the analysis results. The preset standard may be set voluntarily according to the actual geological conditions.

In one embodiment of the present disclosure, the preset standard may include determining a shale section, with a thickness greater than a second lower limit value and an effective layer thickness ratio greater than a third lower limit value, as a favorable interval suitable for in-situ lightening development, and determining a favorable region suitable for in-situ lightening development in the research region according to the standard. In another embodiment of the present disclosure, the thickness of the interlayer between adjacent two of the effective shale intervals may be further determined, and the preset standard may also include that the thickness of the interlayer is less than the first preset threshold.

In another embodiment of the present disclosure, when the thickness of the effective shale interval is greater than a fourth lower limit value, the effective shale interval may be directly determined as a favorable interval suitable for in-situ lightening. That is, the thickness of the shale section is equal to the thickness of the effective shale interval, and the effective layer thickness ratio is 1. When the thickness of the effective shale interval is less than or equal to the fourth lower limit value, adjacent two or more effective shale intervals may be obtained to determine whether the thickness of the interlayer, the thickness of the shale section and the effective layer thickness ratio meet the preset threshold conditions; if so, corresponding shale section is determined as a favorable interval. Then, the favorable region suitable for in-situ lightening development is determined according to the distribution of the favorable intervals in the research region.

During implementation, the first preset threshold value and the second to fourth lower limit values may be preset according to different geological conditions. In some embodiments of the present disclosure, the first preset threshold may range from 0.5 to 2.0 meters, preferably 1 meter. The second lower limit value may range from 10 to 12 meters, preferably 10 meters. The third lower limit value may range from 0.7 to 0.9 meter, preferably 0.8 meter. The fourth lower limit value may range from 8 to 10 meters, preferably 8 meters.

A region meeting the preset standard may be selected as a distribution region suitable for in-situ lightening, and when the area of the distribution region suitable for in-situ lightening is larger than a certain area threshold value, the distribution region is determined as a favorable region suitable for in-situ lightening. For example, the area threshold may range from 10 to 30 km2, preferably 20 km2.

By determine the favorable intervals and the favorable regions using the solutions provided by the above one or more embodiments of the present disclosure, it is possible to reduce the risk of exploration and development, ensure the recovery rate of the shale oil development, and improve the development benefit.

Figure 2:
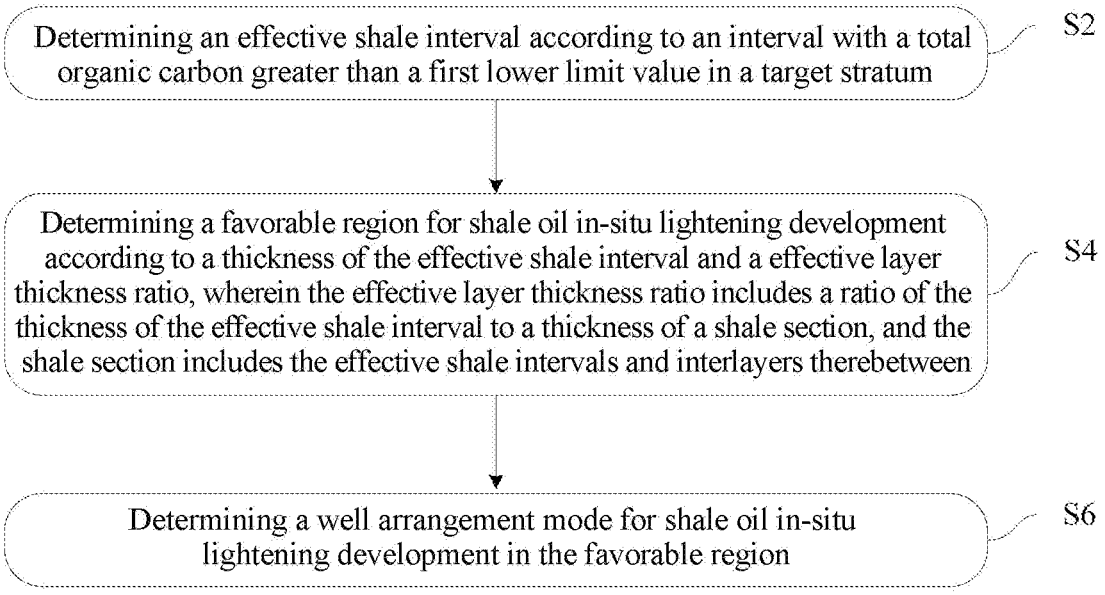
FIG. 2 is a flowchart of a determination of a well arrangement mode in a favorable region in one embodiment provided by the present disclosure.

FIG. 2 is a flowchart of a solution provided in another embodiment of the present disclosure. As illustrated in FIG. 2, the method may further comprise:

S6: determining a well arrangement mode for shale oil in-situ lightening development in the favorable region.

The well arrangement mode for shale oil in-situ lightening development in the favorable region may be further determined, and the shale oil in the favorable region is subjected to an in-situ lightening development according to the well arrangement mode. The well arrangement mode may include arranging heating wells and production wells in the favorable region, wherein the heating well and the production well each comprises a vertical section and a horizontal section, and a heater is disposed in the horizontal section of the heating well. By arranging the heating well in the horizontal section, the heating area and the heating uniformity of the stratum can be increased, thus improving the recovery rate.

In one embodiment of the present disclosure, the completion mode of the favorable region may be determined to realize shale oil in-situ lightening development. The completion mode may include: the heating well adopts a vertical section cased hole completion and a horizontal section open hole completion, and the production well adopts a screen pipe completion.

The completion of the heating well may be a vertical section cased hole completion and a horizontal section open hole completion. The vertical section of the heating well is provided with a heating cable and a connector between a heater and the heating cable, and the horizontal section is provided with the heater. After the heater is placed into the horizontal section, one end of the heater close to the connector is blocked with a high-temperature and high-pressure resistant packer that is disposed in the vertical section of the heating well. Cement is filled above the packer for well sealing, and a length of the cement sealing section ranges from 100 to 300 meters, preferably 200 meters. Thus, the oil and gas leakage due to the generated high pressure can be avoided in the shale heating process. The production well adopts a screen pipe completion. In which, an error of spacing between the horizontal sections of the heating horizontal well and the production horizontal well is less than 1 meter, preferably 0.5 meter.

In another embodiment of the present disclosure, the well arrangement mode may be further determined according to the thickness of the shale section in the favorable region, comprising:

when the thickness of the shale section is less than or equal to the second preset threshold, the heating wells are arranged in parallel in a single layer with linearly equal spacing, and the production wells are located between the heating wells;

when the thickness of the shale section is greater than the second preset threshold, the heating wells are arranged in two or more layers at a triangular pattern, the production wells are arranged at a triangular pattern, and the production wells are located between the heating wells. Preferably, the heating wells and/or the production wells may be arranged with equal spacing. Of course, the spacing between the heating wells or the production wells may also be determined according to the actual needs during implementation.

The second preset threshold may range from 12 to 16 meters, preferably 15 meters.

Through targeted determinations of corresponding well arrangement modes for the shale sections with different thicknesses, it is possible to more efficiently convert the unconverted organic matters and generated hydrocarbons in the shale of medium and low maturities into light oil and natural gas, thus improving the development benefit.

Figure 3:
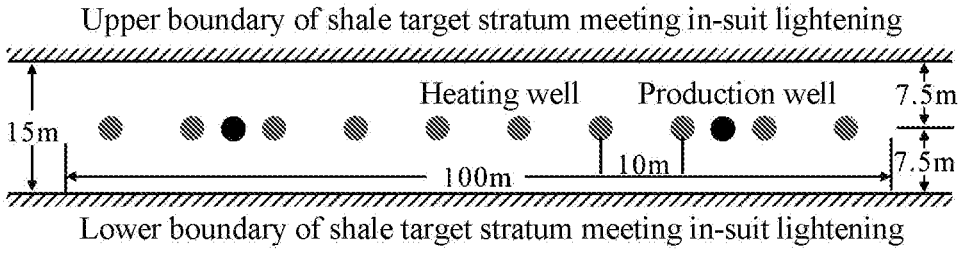
FIG. 3 is a schematic diagram of a cross-section area in a well arrangement mode where a shale section has a thickness of 12 m in another embodiment provided by the present disclosure.

In one embodiment of the present disclosure, when the thickness of the shale section is less than or equal to the second preset threshold, the heating wells may be arranged along a longitudinal centerline of the shale interval to improve the uniformity of heating the shale section, as illustrated in FIG. 3.

In one embodiment of the present disclosure, when the thickness of the shale section is greater than the second preset threshold, the heating wells in a lowest layer may be arranged in parallel to a lower boundary of the shale interval, and orderly, the heating wells in an upper layer may be arranged in a triangle with the heating wells in an adjacent lower layer and parallel thereto, thus improving the uniformity of heating a wide region of the shale section. Preferably, the heating wells in an upper layer and the heating wells in an adjacent lower layer are orderly arranged in an equilateral triangle with an included angle of 60°, thus further improving the uniformity of heating the shale section.

Figure 4:
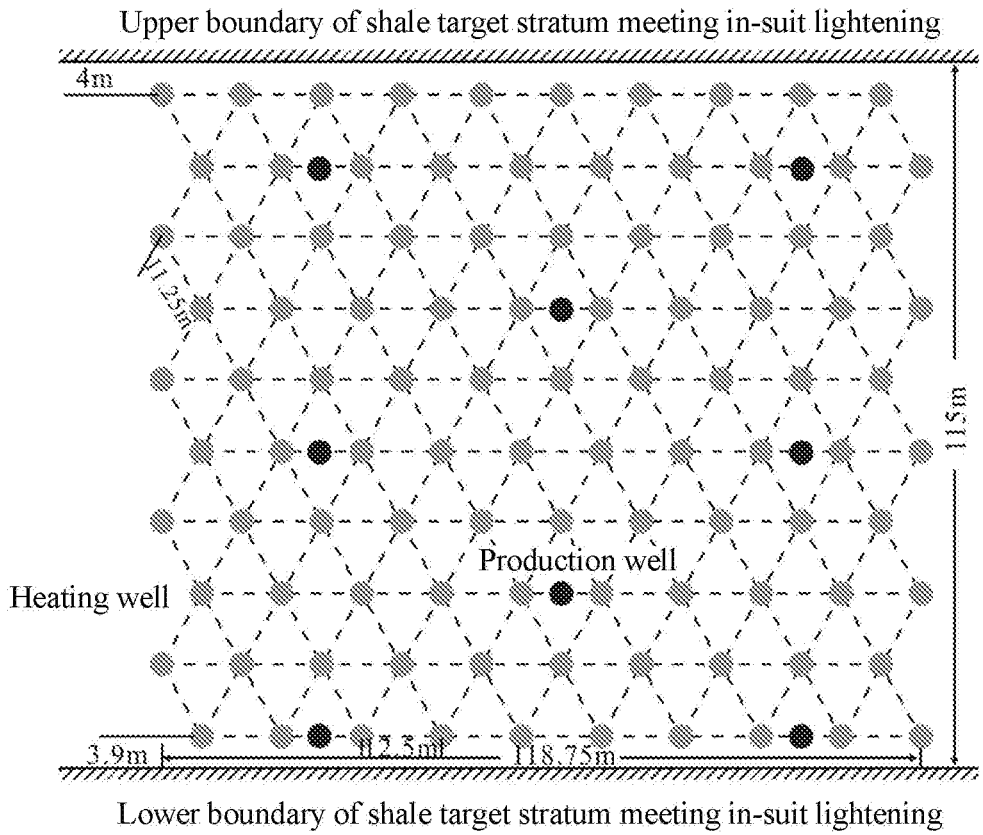
FIG. 4 is a schematic diagram of a cross-section area in a well arrangement mode where a shale section has a thickness of 90 m in another embodiment provided by the present disclosure.

As illustrated in FIG. 4, the heating wells in the lowest layer are arranged in parallel to the lower boundary of the shale interval, and located 3 to 5 meters, preferably 4 meters, above the lower boundary of the shale target stratum; the heating wells in the upper layer and the heating wells in the adjacent lower layer are orderly arranged in an equilateral triangle with an included angle of 60°, in parallel to the heating wells in the lowest layer, and are stacked upwards in sequence. The production wells are arranged in equilateral triangles with an included angle of 60°, and the production wells in the lowest layer are located at the center of the horizontal connection line of corresponding two heating wells and parallel to the heating wells.

In another embodiment of the present disclosure, the heating well spacing may be optimized and determined according to the heating time, so as to reduce the production cost while ensuring the recovery rate. Measurement results of the shale thermal conductivity and the rock volumetric thermal capacity in 17 basins around the world show that the shale thermal conductivity and the rock volumetric thermal capacity are basically consistent, with the average values of 15 Btu/ft/Day/° F. and 25 Btu/ft3/° F. respectively. Based on data of the shale thermal conductivity and the rock volumetric thermal capacity and different well arrangement modes for the heating wells, the heating well spacing may be determined in the following method according to the time (heating time) for reaching the required temperature.

In a case where the heating wells are arranged in parallel in a single layer with linearly equal spacing, after the heating time is determined and when the inter-well center of the heating wells reaches an optimal in-situ lightening temperature of 340° C., the heating well spacing may be obtained through Equation (2).

$$L=a_{21}\times t \tag{2}$$

wherein L represents a heating well spacing, t represents heating time, and $a_{21}$ represents an empirical coefficient. In some embodiments, when the units of L and t are meter and year, respectively, a value of $a_{21}$ may be preferably 0.835.

When the heating wells are arranged in two or more layers at a triangular pattern with equal spacing, the time for different inter-well centers of the heating wells to reach the optimal in-situ light weight temperature of 340° C. may be obtained through Equation (3).

$$L=a_{31}\times t^{a_{32}} \tag{3}$$

wherein L represents a heating well spacing, t represents heating time, and $a_{31}$ and $a_{32}$ represent empirical coefficients. In some embodiments, when the units of L and t are meter and year, respectively, values of $a_{31}$ and $a_{32}$ may be preferably 0.3739 and 0.5125, respectively.

Figure 5:
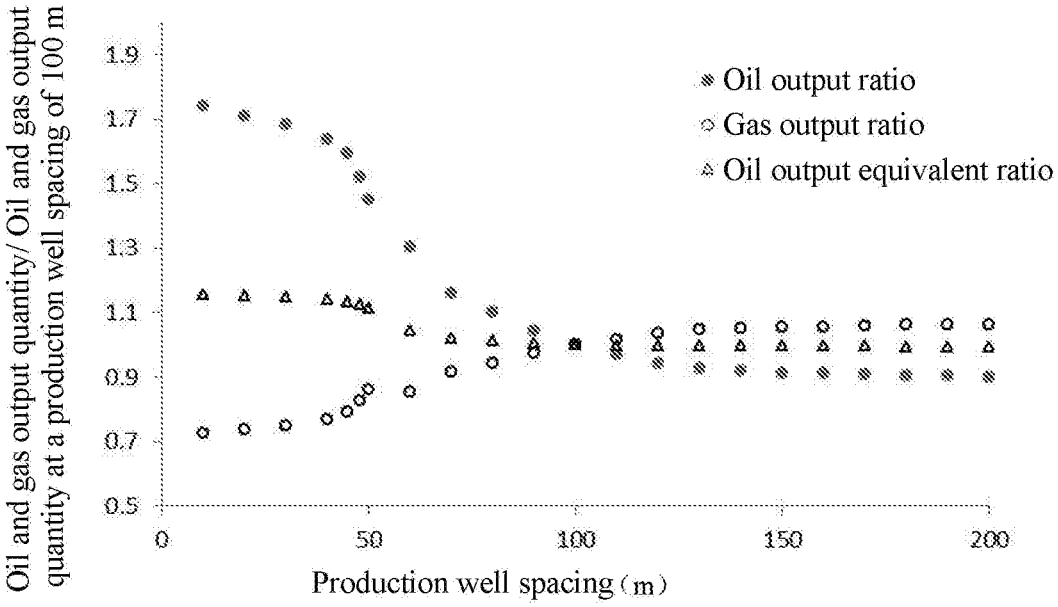
FIG. 5 is a schematic diagram of a relationship between a production well spacing and an oil and gas output quantity/an oil and gas output quantity at a production well spacing of 100 m in another embodiment provided by the present disclosure.

In another embodiment of the present disclosure, the production well spacing may be determined according to a principle of a maximum net value of oil and gas output from the production wells. As illustrated in FIG. 5, the relationships between different production well spacings and the oil and gas output quantities are analyzed, wherein the vertical coordinate represents a ratio of the oil and gas output quantity to an oil and gas output quantity at a production well spacing of 100 m (meters), and the horizontal coordinate represents a production well spacing. As can be seen from the analysis of FIG. 5, as the production well spacing increases, more time is required for the generated oil to be cracked into gas, while the oil output and the oil-gas equivalent weight decrease.

The production well spacing may be determined according to a principle of a maximum net value of oil and gas output from the production wells. For example, the net value of oil and gas output from the production wells at different production well spacings may be calculated through Equation (4) according to a value of oil and gas output, a well drilling and completion cost, an operation cost, and an obsolescence cost of the production wells, so as to obtain an optimal production well spacing according to the principle of a maximum net value of oil and gas output from the production wells.

$$P_{max}=\mathrm{Max}(W_{og}-C_{P_DC}-O_P-A_P) \quad (4)$$

wherein $P_{max}$ represents a net value of oil and gas output from the production wells, $W_{og}$ represents a value of oil and gas output from the production wells, $C_{P_DC}$ represents a well drilling and completion cost of the production wells, $O_P$ represents an operation cost of the production wells, and $A_P$ represents an obsolescence cost of the production wells. During implementation, the units of all parameters should be consistent, for example, ten thousand CNY may be used, to ensure the accuracy of the calculation result.

When the shale section is shorter than the heating well or the production well for one well spacing in the longitudinal direction, well spacings between the heating wells and the horizontal wells may be properly adjusted according to the specific shale thickness. In this way, a high oil and gas recovery rate and a maximum economy are both ensured.

In another embodiment of the present disclosure, the lengths of the horizontal sections of the heating well and the production well may be determined according to a principle of a maximum net value of cumulative oil and gas output from the production well.

When the production wells and the heating wells are arranged, it may be set that the lengths of the horizontal sections of the heating wells and the production wells are consistent. Then, a net value of cumulative oil and gas output from the production wells under different lengths of the horizontal sections may be analyzed through Equation (5) according to drilling and completion costs of the heating wells (including the heaters) and the production wells, operation costs of the heating wells and the production wells, obsolescence costs, and a value of oil and gas output from the production wells, and optimal horizontal section lengths of the heating wells and the production wells may be obtained according to the principle of a maximum net value of cumulative oil and gas output from the production wells.

$$PH_{max}=\mathrm{Max}(W_{P_og}-C_{PH_DC}-O_{PH}-A_{PH}) \quad (5)$$

wherein $PH_{max}$ represents a net value of oil and gas output from the production wells corresponding to the heating wells, $W_{P_og}$ represents a value of cumulative oil and gas output from the production wells corresponding to the heating wells, $C_{PH_DC}$ represents drilling and completion costs of the heating wells and the production wells; $O_{PH}$ represents operation costs of the heating wells and the production wells; and $A_{PH}$ represents obsolescence costs of the heating wells and the production wells. During implementation, the units of all parameters should be consistent, for example, ten thousand CNY may be used, to ensure the accuracy of the calculation results.

The well arrangement modes described in the above one or more embodiments of the present disclosure may ensure the heating uniformity of the shale section to the greatest extent, and improve the shale oil in-situ lightening efficiency. At the same time, the production cost may also be ensured to improve the benefit of the shale oil in-situ lightening development.

In another embodiment of the present disclosure, the heating mode for shale oil in-situ lightening development in the favorable region may be further determined, comprising: heating the heating wells in a preset heating procedure and a heating sequence of the heating wells:

The heating sequence of the heating wells: the heating wells in a distance less than or equal to one heating well spacing from the production wells are started to be heated for a preset heating time firstly, then the heating wells in a distance less than or equal two heating well spacings from the production wells are started to be heated for a preset heating time, and the rest is started to be heated in the same manner until all the heating wells are started;

The heating procedure of the heating wells: when a surface temperature of the heater rises to a highest preset temperature, the highest preset temperature is maintained for a first preset time, then the surface temperature of the heater is lowered to a continuous constant temperature at a preset cooling speed; all the heating wells corresponding to the production wells are maintained at the continuous constant temperature for a second preset time, and then stop being heated.

During this period, the temperature change may also be monitored in real time, so as to ensure that the oil-rich organic shale stratum with medium and low maturities can generate seepage channels for fluid and gas flow, and the oil produced in the shale will not undergo secondary cracking as much as possible, thereby obtaining the maximum crude oil output.

In some embodiments of the present disclosure, the preset maximum temperature of the surface of the heater in the heating well may range from 600° C. to 700° C., preferably 650° C. In the temperature rising process of the heating wells, the heating wells in a distance less than or equal to one heating well spacing from the production wells are started to be heated firstly, then the heating wells in a distance less than or equal two heating well spacings from the production wells are started to be heated, and the rest is started to be heated in the same manner until all the heating wells are started. The heating wells in a distance less than or equal to one heating well spacing are heated for 8 to 12 months, preferably 9 months; the heating wells in a distance less than or equal two heating well spacings are started so that the heaters heat for 8 to 12 months, preferably 9 months; the heating wells in a distance less than or equal three heating well spacings are started so that the heaters heat for 8 to 12 months, preferably 9 months; and so on until all the heating wells are started to be heated.

The temperature rise of the heater of the heating well may adopt the following procedure: when the surface temperature of the heater is less than or equal to 300° C., the temperature rising rate is 10° C. to 20° C./day, preferably 15° C./day; and after the surface temperature of the heater is greater than 300° C., the temperature rising rate is 5° C. to 10° C./day, preferably 8° C./day. When the surface temperature of the heater rises to the preset maximum temperature, it is maintained for 55 to 65 months, preferably 60 months; then, the surface temperature of the heater is lowered to a continuous constant temperature of 380° C. to 420° C., preferably 400° C., at a cooling rate of 5° C. to 10° C./day.

When all the heating wells corresponding to the production wells keep the continuous constant temperature for 12 to 18 months, preferably 15 months, all the heating wells are stopped to be heated.

The heater temperature change may be monitored in real time during the heating process of the heating well, and the time interval of the temperature monitoring in real time may be 1 to 3 hours, preferably 2 hours. The spacing between the detectors of the heater temperature may range from 300 m to 600 m, preferably 400 m.

In another embodiment of the present disclosure, the oil recovery mode for shale oil in-situ lightening development in the favorable region may be further determined, and the oil recovery mode may include: the production wells recover oil by pumping type. Preferably, the oil well pump of the oil well pumping device may be located in the vertical section of the production well above the target stratum at a preset distance that ranges from 100 m to 300 m. By adopting the pumping production mode, the produced crude oil may be output in time to avoid the secondary cracking, thereby ensuring a maximum economic benefit. In one or more embodiments of the present disclosure, a material withstanding a fluid temperature that ranges from 300° C. to 450° C. may be selected for the oil well pumping device of the production well. The relevant devices for the production well may be made of high temperature resistant materials, so as to ensure the normal production under the high temperature state of the output oil and gas.

According to the solutions provided by the above one or more embodiments of the present disclosure, the recovery rate of the shale oil may reach 65% or more, and the energy replacement ratio exceeds 4 in a region meeting the favorable region conditions, thereby improving the benefit of the shale oil in-situ lightening development. The present disclosure overcomes the defect and shortage that the prior arts cannot realize the scaled economic shale oil in-situ scale development, and provides a set of feasible and economical technologies for the shale oil in-situ development.

The embodiments of the present disclosure are all described in a progressive manner, and the same or similar portions of the embodiments can refer to each other. Each embodiment lays an emphasis on its distinctions from other embodiments. Specifically, references may be made to the description of the previous embodiments of related processing, which will be omitted herein.

The particular embodiments of the present disclosure have been described above. Other embodiments fall within the scope of the appended claims. In some cases, the actions or steps recited in the claims may be performed in a different order than in the embodiments and still achieve the desired results. In addition, the processes depicted in the drawings do not necessarily require the illustrated particular order or consecutive order to achieve the desired results. In some embodiments, multitask processing and parallel processing are also possible or favorable.

The shale oil in-situ lightening development method provided in one or more embodiments of the present disclosure can determine an effective shale stratum interval based on the total organic carbon data, and then determine a favorable region suitable for shale oil in-situ lightening development by analyzing the thickness and proportion of the effective shale interval. Next, the well arrangement mode may be optimized in a region that meets the favorable region conditions, thereby realizing the scaled economic shale oil in-situ lightening development.

Figure 6:
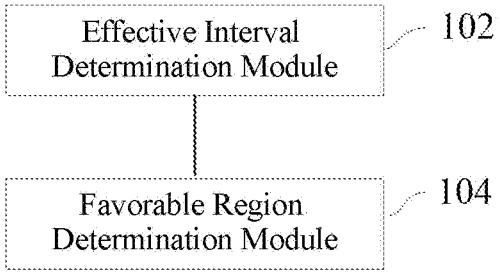
FIG. 6 is a schematic diagram of structures of modules in an embodiment of a shale oil in-situ lightening development apparatus provided by the present disclosure.

Based on the shale oil in-situ lightening development method described above, one or more embodiments of the present disclosure further provide a shale oil in-situ lightening development apparatus, which may include those using systems, software (applications), modules, components, servers, etc. involved in the method described in the embodiments of the present disclosure and combining necessary implementation hardware. Based on the same innovative concept, the apparatus(es) in one or more embodiments provided by the present disclosure will be described in the following embodiments. Since the implementation solution of the apparatus to solve the problem is similar to that of the method, the implementation of the specific apparatus in the embodiments of the present disclosure may refer to that of the aforementioned method, which will not be repeated. As used below, the term "unit" or "module" may be a combination of software and/or hardware that implements a predetermined function. Although the apparatus described in the following embodiments is preferably implemented in software, implementations of hardware, or a combination of software and hardware, are also possible and contemplatable. Specifically, FIG. 6 is a schematic diagram of structures of modules in an embodiment of a shale oil in-situ lightening development apparatus provided by the present disclosure. As illustrated in FIG. 6, the apparatus may comprise:

an effective interval determination module 102 configured to determine an effective shale interval according to an interval with a total organic carbon greater than a first lower limit value in a target stratum;

a favorable region determination module 104 configured to determine a favorable region for shale oil in-situ lightening development according to a thickness of the effective shale interval and an effective layer thickness ratio, wherein the effective layer thickness ratio includes a ratio of the thickness of the effective shale interval to a thickness of a shale section, and the shale section includes the effective shale intervals and interlayers therebetween.

It should be noted that the apparatus described above may also include other embodiments according to the description of the method embodiments. The specific implementations may refer to the description of related method embodiments and will not be repeated herein.

The shale oil in-situ lightening development apparatus provided in one or more embodiments of the present disclosure can determine an effective shale stratum interval based on the total organic carbon data, and then determine a favorable region suitable for shale oil in-situ lightening development by analyzing the thickness and proportion of the effective shale interval. Next, the well arrangement mode may be optimized in a region that meets the favorable region conditions, thereby realizing the scaled economic shale oil in-situ lightening development.

The method or apparatus described in the above embodiments provided in the present disclosure may realize a service logic by a computer program and record it in a storage medium that is readable and executable by a computer to achieve the effects of the solutions described in the embodiments of the present disclosure. Thus, the present disclosure further provides a shale oil in-situ lightening development device, comprising a processor and a memory for storing instructions executable by the processor, wherein when being executed by the processor, the instructions implement the steps of:

determining an effective shale interval according to an interval with a total organic carbon greater than a first lower limit value in a target stratum;

determining a favorable region for shale oil in-situ lightening development according to a thickness of the effective shale interval and an effective layer thickness ratio, wherein the effective layer thickness ratio includes a ratio of the thickness of the effective shale interval to a thickness of a shale section, and the shale section includes the effective shale intervals and interlayers therebetween.

The storage medium may include a physical device for storing information that is usually digitized and then stored in a medium using electronic, magnetic or optical methods. The storage medium may further include a device that stores information by means of electric energy, such as RAM and ROM; a device that stores information by means of magnetic energy, such as hard disk, floppy disk, magnetic tape, magnetic core memory, magnetic bubble memory and U disk; and a device that stores information optically, such as CD or DVD. Of course, there may be other forms of storage mediums, such as a quantum memory, a graphene memory, etc.

It should be noted that according to the description of method embodiments, the above processing device may further include other embodiments. The specific implementations may refer to the description of related method embodiments, and will not be repeated herein.

The shale oil in-situ lightening development device described in the above embodiments can determine an effective shale stratum interval based on the total organic carbon data, and then determine a favorable region suitable for shale oil in-situ lightening development by analyzing the thickness and proportion of the effective shale interval. Next, the well arrangement mode may be optimized in a region that meets the favorable region conditions, thereby realizing the scaled economic shale oil in-situ lightening development.

The present disclosure further provides a shale oil in-situ lightening development system, which may be a system for determining a favorable region for shale oil in-situ lightening development, and may also be a system for further determining well arrangement modes of the production wells and the heating wells in the favorable region. For example, the system may be software (application), actual operation device, logic gate circuit device, quantum computer, etc. and a terminal device combining necessary implementation hardware. The shale oil in-situ lightening development system comprises at least one processor and a memory for storing computer executable instructions, wherein when executing the instructions, the processor implements the steps of the method in any one of the above method embodiments.

Another embodiment of the present disclosure further provides a shale oil in-situ lightening development system, which may include the heating wells, the production wells and the heaters arranged according to the solution of any one of the above method embodiments, and heating cables, wherein the heating well and the production well may each comprise a vertical section and a horizontal section, the heating cable and the heater may be connected through a connector, the heating cable and the connector may be disposed in the vertical section of the heating well, and the heater may be disposed in the horizontal section of the heating well.

The shale oil in-situ lightening development system in this embodiment performs the shale oil in-situ lightening development according to the production wells and the heating wells arranged in corresponding favorable region, so as to increase the efficiency of the shale oil in-situ lightening development to the greatest extent, while improving the benefit of the shale oil in-situ lightening development.

In one embodiment of the present disclosure, the vertical section of the heating well may also be provided with a packer, which may be disposed between the heater and the connector and close to the heater, and cement may be filled above the packer for well sealing, thus preventing the oil and gas leakage due to the high pressure generated in the shale heating process.

In another embodiment of the present disclosure, the system may further comprise an oil well pumping device for the pumping development of the production well. Preferably, the oil well pump of the oil well pumping device may be disposed in the vertical section of the production well at a position 100 m to 300 m above the target stratum. Based on the pumping production mode, the produced crude oil may be output in time without secondary cracking as far as possible, thus ensuring the maximum economic benefit.

It should be noted that the apparatus or system described above may also comprise other embodiments according to the description of method embodiments. The specific implementation may refer to the description of related method embodiments and will not be repeated herein.

The shale oil in-situ lightening development system described in the above embodiment may arrange the wells in the regions meeting the favorable region conditions, and exploit the shale oil in the pumping production mode, thereby improving the efficiency of the shale oil in-situ lightening development and ensuring the benefit of the shale oil in-situ lightening development to the greatest extent.

It should be noted that the apparatus or system described above in the present disclosure may also include other embodiments according to the description of the method embodiments. The specific implementations may refer to the description of related method embodiments and will not be repeated herein. The embodiments of the present disclosure are all described in a progressive manner, and the same or similar portions of the embodiments can refer to each other. Each embodiment lays an emphasis on its distinctions from other embodiments. In particular, the embodiments such as hardware+program and storage medium+program are simply described since they are substantially similar to the method embodiment, and please refer to the description of the method embodiment for the relevant portions.

Although the embodiments of the present disclosure mention the operations and the data description such as the acquisition, definition, interaction, calculation, judgment, etc. of the total organic carbon, well spacing, horizontal section length, etc., the embodiments of the present disclosure are not limited to those that must meet the standard data model/template or the situations described in the embodiments of the present disclosure. Some industrial standards or self-defined embodiments or those slightly modified based on the implementations described in the above embodiments may achieve the same, equivalent or similar, or modification-predictable implementation effects of the above embodiments. The embodiments obtained by applying the amended or modified data acquisition, storage, judgment, processing methods may still fall within the scope of optional embodiments of the present disclosure.

The particular embodiments of the present disclosure have been described above. Other embodiments fall within the scope of the appended claims. In some cases, the actions or steps recited in the claims may be performed in a different order than in the embodiments and still achieve the desired results. In addition, the processes depicted in the drawings do not necessarily require the illustrated particular order or consecutive order to achieve the desired results. In some embodiments, multitask processing and parallel processing are also possible or favorable.

Any system, apparatus, module or unit set forth in the embodiments specifically may be implemented by a computer chip or an entity, or by a product having a certain function. A typical implementation device is a computer. Specifically, the computer may be, for example, a personal computer, a laptop computer, a vehicle-mounted man-machine interaction device, a tablet computer, or a combination of any of these devices.

For the convenience of description, the above apparatus is described into various modules in terms of functions. Of course, when implementing one or more embodiments of the present disclosure, the functions of various modules may be realized in the same one or more software and/or hardware, and a module that realizes the same function may also be implemented by a combination of a plurality of sub-modules or sub-units, etc. The apparatus embodiment described above is only schematic. For example, the division of the units is only a logical function division. In actual implementation, there may be other division methods. For example, a plurality of units or components may be combined or integrated into another system, or some features may be ignored or not implemented. On the other hand, the mutual coupling or direct coupling or communication connection illustrated or discussed may be indirect coupling or communication connection through some interfaces, devices or units, and may be in electrical, mechanical or other forms.

A person skilled in the art also know that besides implementing the controller in the form of pure computer readable program codes, it is entirely possible to perform logic programming on the method steps, so that the controller realizes the same function in a form of logic gate, switch, application specific integrated circuit, programmable logic controller, embedded microcontroller, etc. Thus, such a controller may be considered as a hardware component, and means comprised therein for implementing various functions may also be considered as structures within the hardware component. Or even, the means for realizing various functions may be regarded as both software modules for realizing a method and structures within the hardware component.

The present disclosure is described with reference to a flow diagram and/or a block diagram of the method, apparatus (system) and computer program product according to the embodiments of the present disclosure. It should be appreciated that each flow and/or block in the flow diagram and/or the block diagram and a combination of flows and/or blocks in the flow diagram and/or the block diagram can be realized by computer program instructions. Those computer program instructions can be provided to a general computer, a dedicated computer, an embedded processor or a processor of other programmable data processing device to produce a machine, so that the instructions executed by the processor of the computer or other programmable data processing device produce means for realizing specified functions in one or more flows in the flow diagram and/or one or more blocks in the block diagram.

These computer program instructions may also be loaded onto the computer or other programmable data processing devices, so that a series of operation steps are performed on the computer or other programmable data processing devices to produce a processing realized by the computer, thus the instructions executed on the computer or other programmable devices provide step(s) for realizing function(s) specified in one or more flows in the flow diagram and/or one or more blocks in the block diagram.

In a typical configuration, the computing device comprises one or more processors (CPUs), an input/output interface, a network interface and a memory.

Further to be noted, the term "comprise", "include" or any other variant intends to cover the non-exclusive inclusions, so that a process, a method, a commodity or a device comprising a series of elements comprise not only those elements, but also other elements not explicitly listed, or further comprise inherent elements of such process, method, commodity or device. In a case where there is no further limitation, the elements defined by a sentence "comprising a . . . " do not exclude other identical elements existing in the process, method, commodity or device comprising the elements.

One or more embodiments of the present disclosure may be described in the general context of computer executable instructions executed by the computer, e.g., the program module. In general, the program module includes routine, program, object, component, data structure, etc. executing a particular task or realizing a particular abstract data type. One or more embodiments of the present disclosure may also be put into practice in the distributed computing environments where tasks are executed by remote processing devices connected through a communication network. In the distributed computing environments, the program modules may be located in the local and remote computer storage medium including the storage device.

The embodiments of the present disclosure are all described in a progressive manner, and the same or similar portions of the embodiments can refer to each other. Each embodiment lays an emphasis on its distinctions from other embodiments. In particular, the system embodiment is simply described since it is substantially similar to the method embodiment, and please refer to the description of the method embodiment for the relevant portions. In the description of the present disclosure, the description of reference terms "one embodiment", "some embodiments", "examples", "specific examples" or "some examples" and the like mean that the specific features, structures, materials, or characteristics described in conjunction with the embodiment(s) or example(s) are comprised in at least one embodiment or example of the present disclosure. In the present disclosure, the schematic expressions of the above terms do not necessarily aim at the same embodiment or example. Moreover, the specific features, structures, materials, or characteristics described may be combined in any one or more embodiments or examples in a suitable manner. In addition, a person skilled in the art may combine different embodiments or examples described in the present disclosure and features thereof if there is no contradiction.

Those described above are just embodiments of the present disclosure, rather than limitations to the present disclosure. For a person skilled in the art, the present disclosure is intended to cover various amendments or variations. Any amendment, equivalent substitution, improvement, etc. made under the spirit and principle of the present disclosure should fall within the scope of the claims of the present disclosure.

While example embodiments have been particularly shown and described, it will be understood by those skilled in the art that various changes in form and details may be made therein without departing from the scope of the embodiments encompassed by the appended claims.

What is claimed is:

1. A shale oil in-situ lightening development method, comprising:

determining effective shale intervals according to an interval with a total organic carbon greater than a first lower limit value in a target stratum;

determining a favorable region for shale oil in-situ lightening development according to a thickness of the effective shale intervals and an effective layer thickness ratio, wherein the effective layer thickness ratio includes a ratio of the thickness of the effective shale intervals to a thickness of a shale section, and the shale section includes the effective shale intervals and interlayers between the effective shale intervals; and determining a well arrangement mode for shale oil in-situ lightening development in the favorable region, comprising:

arranging heating wells and production wells in the favorable region, wherein the heating well and the production well each comprise a vertical section and a horizontal section, and a heater is disposed in the horizontal section of the heating well, arranging the heating wells in an upper layer and the heating wells in an adjacent lower layer at an equilateral triangular pattern with an included angle of 60°, arranging the production wells at an equilateral triangular pattern with an included angle of 60°, and locating the production wells between the heating wells, and the production wells in the lowest layer are located at the center of the horizontal connection line of corresponding two heating wells and parallel to the heating wells, wherein the total organic carbon refers to the mass percentage of carbon in the organic matter of the rock.

2. The shale oil in-situ lightening development method according to claim 1, wherein determining effective shale intervals according to an interval with a total organic carbon greater than a first lower limit value in a target stratum comprises:

determining a region to be selected according to a kerogen type of the target stratum; and determining the effective shale intervals according to an interval with a total organic carbon greater than the first lower limit value in the region to be selected.

3. The shale oil in-situ lightening development method according to claim 1, wherein determining a favorable region for shale oil in-situ lightening development comprises:

a) determining the shale section as a favorable interval when a thickness of the interlayer is less than a first preset threshold, a thickness of the shale section is greater than a second lower limit value, and the effective layer thickness ratio is greater than a third lower limit value;

or b) determining the effective shale intervals as a favorable interval when the thickness of the effective shale intervals is greater than a fourth lower limit value; then determining the favorable region for shale oil in-situ lightening development according to the favorable interval in a) or b).

4. The shale oil in-situ lightening development method according to claim 1, wherein determining a well arrangement mode for shale oil in-situ lightening development in the favorable region comprises:

adopting a vertical section cased hole completion and a horizontal section open hole completion for the heating wells, and adopting a screen pipe completion for the production wells.

5. The shale oil in-situ lightening development method according to claim 1, wherein determining a well arrangement mode for shale oil in-situ lightening development in the favorable region comprises:

arranging the heating wells and/or the production wells with equal spacing.

6. The shale oil in-situ lightening development method according to claim 1, wherein determining a well arrangement mode for shale oil in-situ lightening development in the favorable region comprises:

arranging the heating wells along a longitudinal centerline of the shale interval.

7. The shale oil in-situ lightening development method according to claim 1, wherein determining a well arrangement mode for shale oil in-situ lightening development in the favorable region comprises:

arranging the heating wells in a lowest layer in parallel to a lower boundary of the shale interval and arranging the heating wells in an upper layer in parallel to the heating wells in an adjacent lower layer.

8. The shale oil in-situ lightening development method according to claim 1, wherein determining a well arrangement mode for shale oil in-situ lightening development in the favorable region comprises: determining a heating well spacing according to heating time.

9. The shale oil in-situ lightening development method according to claim 1, wherein determining a well arrangement mode for shale oil in-situ lightening development in the favorable region comprises:

determining a production well spacing according to a principle of a maximum net value of oil and gas output from the production wells.

10. The shale oil in-situ lightening development method according to claim 1, wherein determining a well arrangement mode for shale oil in-situ lightening development in the favorable region comprises:

determining lengths of the horizontal sections of the heating well and the production well according to a principle of a maximum net value of cumulative oil and gas output from the production wells.

11. The shale oil in-situ lightening development method according to claim 1, further comprising:

determining a heating mode for shale oil in-situ lightening development in the favorable region, comprising:

a heating sequence of the heating wells: the heating wells in a distance less than or equal to one heating well spacing from the production wells are started to be heated for a preset heating time firstly, then the heating wells in a distance less than or equal to two heating well spacings from the production wells are started to be heated for a preset heating time, and the rest is started to be heated in the same manner until all the heating wells are started;

a heating procedure of the heating wells: after a surface temperature of the heater rises to a highest preset temperature, the highest preset temperature is maintained for a first preset time, then the surface temperature of the heater is lowered to a continuous constant temperature at a preset cooling speed; all the heating wells are maintained at the continuous constant temperature for a second preset time, and then stop being heated.

12. The shale oil in-situ lightening development method according to claim 1, further comprising:

determining an oil recovery mode for shale oil in-situ lightening development in the favorable region, comprising:

recovering oil by pumping from the production well, wherein an oil well pump is located in the vertical section of the production well above the target stratum for a preset distance that ranges from 100 m to 300 m;

wherein a material of an oil well pumping device for the production well withstands a fluid temperature that ranges from 300° C. to 450° C.

13. A shale oil in-situ lightening development system, comprising the heating wells, the production wells and the heaters arranged in the favorable region in the method according to claim 1, and heating cables;

the heating well and the production well each comprise a vertical section and a horizontal section, the heating cable and the heater are connected through a connector, the heating cable and the connector are disposed in the vertical section of the heating well, and the heater is disposed in the horizontal section of the heating well.

14. The shale oil in-situ lightening development system according to claim 13, wherein the vertical section of the heating well is provided with a packer that is disposed between the heater and the connector, and cement is filled above the packer for well sealing.

15. A shale oil in-situ lightening development apparatus, comprising:

an effective interval determination module configured to determine effective shale intervals according to an interval with a total organic carbon greater than a first lower limit value in a target stratum;

a favorable region determination module configured to determine a favorable region for shale oil in-situ lightening development according to a thickness of the effective shale intervals and an effective layer thickness ratio, wherein the effective layer thickness ratio includes a ratio of the thickness of the effective shale intervals to a thickness of a shale section, and the shale section includes the effective shale intervals and interlayers between the effective shale intervals; and heating wells and production wells arranged in the favorable region, wherein the heating well and the production well each comprise a vertical section and a horizontal section, and a heater is disposed in the horizontal section of the heating well, the heating wells are arranged in an upper layer and an adjacent lower layer at an equilateral triangular pattern with an included angle of 60°, the production wells are arranged at an equilateral triangular pattern with an included angle of 60°, and the production wells are located between the heating wells, and the production wells in the lowest layer are located at the center of the horizontal connection line of corresponding two heating wells and parallel to the heating wells, wherein the total organic carbon refers to the mass percentage of carbon in the organic matter of the rock.

* * * * *